US012774509B2

(12) United States Patent
Chintha et al.

(10) Patent No.: US 12,774,509 B2
(45) Date of Patent: Oct. 27, 2026

(54) METHOD FOR PRODUCING SPHEROIDIZED OR NON-LAMELLAR MICROSTRUCTURE STEELS

(71) Applicant: Tata Steel Limited, Jamshedpur (IN)

(72) Inventors: Appa Rao Chintha, Jamshedpur (IN); M.B.N. Raju, Jamshedpur (IN); Pankaj Raju, Jamshedpur (IN); Basavaraj P Kalinganavar, Jamshedpur (IN); V.K. Shah, Jamshedpur (IN); Monojit Dutta, Jamshedpur (IN); Avtar Singh Saini, Jamshedpur (IN); Sanjay Chandra, Jamshedpur (IN); Vinay V. Mahshabde, Jamshedpur (IN)

(73) Assignee: Tata Steel Limited, Jamshedpur (IN)

( * ) Notice: Subject to any disclaimer, the term of this patent is extended or adjusted under 35 U.S.C. 154(b) by 316 days.

(21) Appl. No.: 18/004,437

(22) PCT Filed: Mar. 23, 2021

(86) PCT No.: PCT/IB2021/052372

§ 371 (c)(1),
(2) Date: Jan. 5, 2023

(87) PCT Pub. No.: WO2022/167847

PCT Pub. Date: Aug. 11, 2022

(65) Prior Publication Data

US 2023/0357905 A1 Nov. 9, 2023

(30) Foreign Application Priority Data

Feb. 2, 2021 (IN) ..... 202131004493

(51) Int. Cl.
*C22C 38/12* (2006.01)
*C21D 8/02* (2006.01)
(Continued)

(52) U.S. Cl.
CPC ..... *C22C 38/12* (2013.01); *C21D 8/02* (2013.01); *C21D 9/0081* (2013.01); *C21D 8/0226* (2013.01); *C21D 2211/001* (2013.01)

(58) Field of Classification Search
CPC ..... C22C 1/02; C22C 38/001; C22C 38/02; C22C 38/04; C22C 38/06; C22C 38/12;
(Continued)

(56) References Cited

U.S. PATENT DOCUMENTS

2010/0215539 A1* 8/2010 Edelman ..... C22C 38/02 164/463
2013/0202914 A1* 8/2013 Edelman ..... C22C 38/02 148/541

FOREIGN PATENT DOCUMENTS

JP 2018062692 A * 4/2018
WO WO 2015/020028 2/2015

OTHER PUBLICATIONS

On-line translation of JP-2018062692-A, Apr. 2018 (Year: 2018).*
(Continued)

*Primary Examiner* — Jie Yang
(74) *Attorney, Agent, or Firm* — Knobbe, Martens, Olson & Bear, LLP

(57) ABSTRACT

The present disclosure discloses a method for producing high strength hot rolled steel. The method includes casting a steel slab of a composition, comprising in weight %: carbon (C) of about 0.45 wt. %-1.2 wt. %, manganese (Mn) of about 0.0-1.0 wt. %, silicon (Si) of about 0.0-0.5 wt. %, niobium (Nb) up-to 0.03 wt. %, sulphur (S) up-to 0.05 wt. % of S, phosphorous (P) up-to 0.05 wt. %, nitrogen (N) 0.002 wt. %-0.012 wt. % and balance being Iron (Fe) optionally along with incidental elements. The method also involves, heating, hot rolling, cooling, coiling the steel and retaining the steel at an ambient temperature to produce high
(Continued)

strength hot rolled steel with 75-95% spheroid microstructure and 5-25% pearlite microstructure.

9 Claims, 11 Drawing Sheets

(51) Int. Cl.
*C21D 9/00* (2006.01)
*C21D 8/0221* (2026.01)

(58) Field of Classification Search
CPC . C22C 38/18; C21D 2211/009; C21D 8/0226; C21D 8/0205; C21D 8/0263; B22D 11/001; B22D 11/0408
See application file for complete search history.

(56) References Cited

OTHER PUBLICATIONS

International Search Report in PCT/IB2021/052372 dated Oct. 8, 2021 in 11 pages.
International Preliminary Report on Patentability dated Aug. 3, 2023 in PCT/IB2021/052372 dated in 9 pages.

* cited by examiner

METHOD FOR PRODUCING SPHEROIDIZED OR NON-LAMELLAR MICROSTRUCTURE STEELS

TECHNICAL FIELD

Present disclosure relates in general to a field of material science and metallurgy. Particularly, but not exclusively, the present disclosure relates to a method of producing high strength hot rolled steel. Further, embodiments of the disclosure disclose the method for producing high strength hot rolled steel that comprises 75-95% spheroid microstructure and 5-25% pearlite microstructure.

BACKGROUND OF THE DISCLOSURE

Steel is an alloy of iron, carbon, and other elements such as Phosphorous (P), Sulphur (S), Nitrogen (N), Manganese (Mn), Silicon (Si), Chromium (Cr), etc. Because of its high tensile strength and low cost, steel may be considered as a most viable choice for major components manufacturing in a wide variety of applications. Some of the applications of the steel may include buildings, ships, tools, automobiles, machines, bridges, and numerous other applications.

Steel may be generally manufactured as steel slabs by processes such as casting including but not limiting to continuous casting, and then the steel is formed into various shapes depending on the application. One such common form of steel is a steel sheet which is obtained by converting the steel slab into steel sheet by series of metal forming processes to find its use in the sheet metal industry. During drawing of the steel sheet from steel slabs, processes such as hot rolling and cold rolling are carried out.

Conventionally, hot rolling may be performed in a Hot Strip Mill (HSM) which is an integral part of an integrated steel plant. The primary objective of HSM is to make strips from slabs and acquire intended properties in the strips. Typically, HSM has two sections—Roughing Mill and Finishing Mill. Roughing Mill is essentially a single strand reversing mill whose function is to reduce the thickness of the slabs as well as break the cast structure. After roughing, strips go into the finishing mill. The job of a finishing mill is to reduce the thickness of the strips and incorporates requisite properties into the strips. Thus, the HSM may process the slabs into strips and the various operational parameters of the HSM may influence the properties or the microstructure of the strip. The slabs are generally processed by the HSM to obtain the strip with a eutectoid and hypo/hyper-eutectoid steels containing pearlite. Pearlite is a two phased lamellar structure composed of alternative layers of ferrite and cementite. The strips with the pearlite microstructure may be used for producing various products like cutting saws, automotive components (Circlips, Washers, Springs, and Recliner, Driven and disc plate, clutch plates, chain links, telescopic front fork of two-wheelers and bearings), gardening tools, surgical blade, springs, measuring devices, wire rods, tire bead wires, deep drawn high strength wires, wires for suspension bridges, and others.

The pearlite microstructure in any strip often imparts hardness and strength to the strip. However, the strip with perlite microstructure is not particularly tough or ductile and has very low machinability. Low ductility makes it difficult to shape or machine the hot rolled pearlitic or high carbon steels during the process of manufacturing a component. Consequently, the pearlitic steel must be heat treated into a softened condition or spheroidized condition. The steel may be subsequently machined after the heat treatment. The steels having microstructures consisting largely of lamellar pearlite, are frequently subjected to heat treatment for changing the distribution of the carbides from a lamellar to a non-lamellar or spheroidal form. The non-lamellar or spheroidal form in the steels improve machineability, cold rolling or bending properties, ductility and toughness as measured by tensile and notch impact tests. The spheroidal form also decreases hardenability of the steels. As mentioned above, the steels with pearlitic structure must be subjected to an intermediate heat treatment steps to impart the spheroid structure suitable for machining with properties of cold rolling, ductility, toughness etc. Consequently, the overall operation costs and the time consumed for processing the slab to the strip with spheroid structure increases.

Conventionally, the steel industry has relied on two methods for imparting the spheroidal structure to the steel. The first step involves heat-treatment with a very long heating period at a temperature near the eutectoid transformation or alternately just above and just below the critical temperature, followed by slow cooling to room temperature. The second method is the quench and temper treatment. The steel in this method is quenched in oil from a temperature appreciably above the eutectoid temperature, followed by tempering for a long time at a temperature not far below the eutectoid temperature. Further, expensive microalloying additions such as titanium, vanadium, molybdenum etc., are used in conventional methods to obtain the required spheroidal structure.

Korean patent "KR100722390B1" discloses a method of producing the spheroidized structure in medium carbon steel by quenching hot rolled sheet to obtain mixture of bainite and martensite and then tempering the steel to obtain fine spheroids of cementite. However, the method disclosed in the above patent requires an additional heat treatment step for spheroidization that incurs additional time and cost. PCT publication number "WO2006088019A1" discloses the production of medium carbon wire rods with spheroidized cementite microstructure. The method involves multiple steps to produce the final product. The first step involves coiling the hot formed wire to a temperature above the eutectoid temperature, followed by cooling at a specific cooling rate to about 400-550° C. The wire is subsequently subjected to an isothermal treatment at that temperature and is finally cooled to a room temperature to obtain hot rolled wire with complex microstructure. The hot rolled wire is further cold rolled and annealed to obtain spheroidized cementite from the complex microstructure and cold deformation. The above process for imparting the spheroidized structure to the wire is rather expensive and complex.

The existing methods for imparting the spheroidized structure to steel either disclose prolonged isothermal treatment or involve complex heat treatment steps at high temperatures which drastically increases the overall operational time and cost. The above disclosed existing methods are also not economical for the mass production of steel with the spheroidized structure.

The present disclosure is directed to overcome one or more limitations stated above or any other limitation associated with the conventional arts.

SUMMARY OF THE DISCLOSURE

One or more shortcomings of the prior art are overcome by a method and a product as claimed and additional advantages are provided through the method as described in the present disclosure.

Additional features and advantages are realized through the techniques of the present disclosure. Other embodiments and aspects of the disclosure are described in detail herein and are considered a part of the claimed disclosure.

In one non limiting embodiment of the disclosure, a method for producing high strength hot rolled steel is disclosed. The method includes casting a steel slab of a composition, comprising in weight %: carbon (C) of about 0.3 wt. %-1.5 wt. %, manganese (Mn) of about 0.0-1.0 wt. %, silicon (Si) of about 0.0-0.5 wt. %, niobium (Nb) up-to 0.03 wt. %, sulphur (S) up-to 0.05 wt. % of S, phosphorous (P) up-to 0.05 wt. %, nitrogen (N) 0.002 wt. %-0.012 wt. % and balance being Iron (Fe) optionally along with incidental elements. The method also involves, hot rolling the steel slab at a temperature ranging from Ae3 to Ae3+100° C., where Ae3 is the temperature at which transformation of austenite to ferrite starts at equilibrium and strain accumulation takes place during at least two strands of hot rolling. The steel is further cooled to a coiling temperature at a cooling rate of 5° C./s-40° C./s. Further, the steel is coiled at the coiling temperature and is retained at an ambient temperature for 1-24 hr to obtain high strength hot rolled steel, where the high strength hot rolled steel is formed and comprises of 75-95% spheroid or non-lamellar microstructure with 5-25% pearlite microstructure.

In an embodiment, the high-strength hot-rolled steel exhibits ultimate tensile strength greater than 950 MPa.

In an embodiment, the austenitizing temperature ranges from 1100° C. to 1250° C. and the first pre-determined time ranges from 20 minutes to 4 hours.

In an embodiment, the Ae3 temperature ranges from of about 710° C. to about 940° C.

In an embodiment, the strain accumulation during the at least two strands of hot rolling is achieved by controlling parameters including strain rate, finish rolling temperature and a desired austenite grain size during the hot rolling.

In an embodiment, the at least two strands are the last two stands of hot rolling. In an embodiment, the parameters are determined by calculating a peak strain for hot rolling the steel to achieve a desired austenite grain size in the steel.

In an embodiment, the coiling temperature is $Ae1-175<T_{CT}<Ae1-75$, where Ae1 is the temperature at which austenite to ferrite is completed.

In an embodiment, the steel is retained at an ambient temperature for time-period ranging from 1 hour to 24 hours to obtain high strength hot rolled steel.

In an embodiment, the high-strength hot-rolled steel exhibits total elongation greater than 15% and the grain size of high strength hot rolled steel ranges from 2 μm to 5 μm. Further, the size of the spheroid microstructure in steel is below 200 nm and average size of the spheroids is 100 nm.

In an embodiment, the yield to tensile strength ratio of the high strength hot rolled steel is between 0.65-0.75 and the strain hardening exponent of the high strength hot rolled steel is between 0.18-0.2.

In another non limiting embodiment of the disclosure, a high strength hot rolled steel is disclosed. The steel includes a composition, comprising in weight %: carbon (C) of about 0.45 wt. %-1.2 wt. %, manganese (Mn) of about 0.0-1.0 wt. %, silicon (Si) of about 0.0-0.5 wt. %, niobium (Nb) up-to 0.03 wt. %, sulphur (S) up-to 0.05 wt. % of S, phosphorous (P) up-to 0.05 wt. %, nitrogen (N) 0.002 wt. %-0.012 wt. % and balance being Iron (Fe) optionally along with incidental elements. The high strength hot rolled steel comprises 75-95% spheroid microstructure and 5-25% pearlite microstructure.

It is to be understood that the aspects and embodiments of the disclosure described above may be used in any combination with each other. Several of the aspects and embodiments may be combined to form a further embodiment of the disclosure.

The foregoing summary is illustrative only and is not intended to be in any way limiting. In addition to the illustrative aspects, embodiments, and features described above, further aspects, embodiments, and features will become apparent by reference to the drawings and the following detailed description.

BRIEF DESCRIPTION OF THE ACCOMPANYING FIGURES

The novel features and characteristics of the disclosure are set forth in the appended description. The disclosure itself, however, as well as a preferred mode of use, further objectives, and advantages thereof, will best be understood by reference to the following detailed description of an illustrative embodiment when read in conjunction with the accompanying figures. One or more embodiments are now described, by way of example only, with reference to the accompanying figures wherein like reference numerals represent like elements and in which:

FIG. 1 is a flowchart illustrating a method for producing high strength hot rolled steel, according to an exemplary embodiment of the present disclosure.

FIG. 2*a* is a graphical representation showing mean flow stress v/s temperature of the conventional rolling schedule which produce pearlite.

FIG. 2*b* is a graphical representation showing mean flow stress v/s temperature of the rolling schedule in the present disclosure resulting in strain accumulation causing a refined grain size in the steel sheet, according to an exemplary embodiment of the present disclosure.

Figure 7:
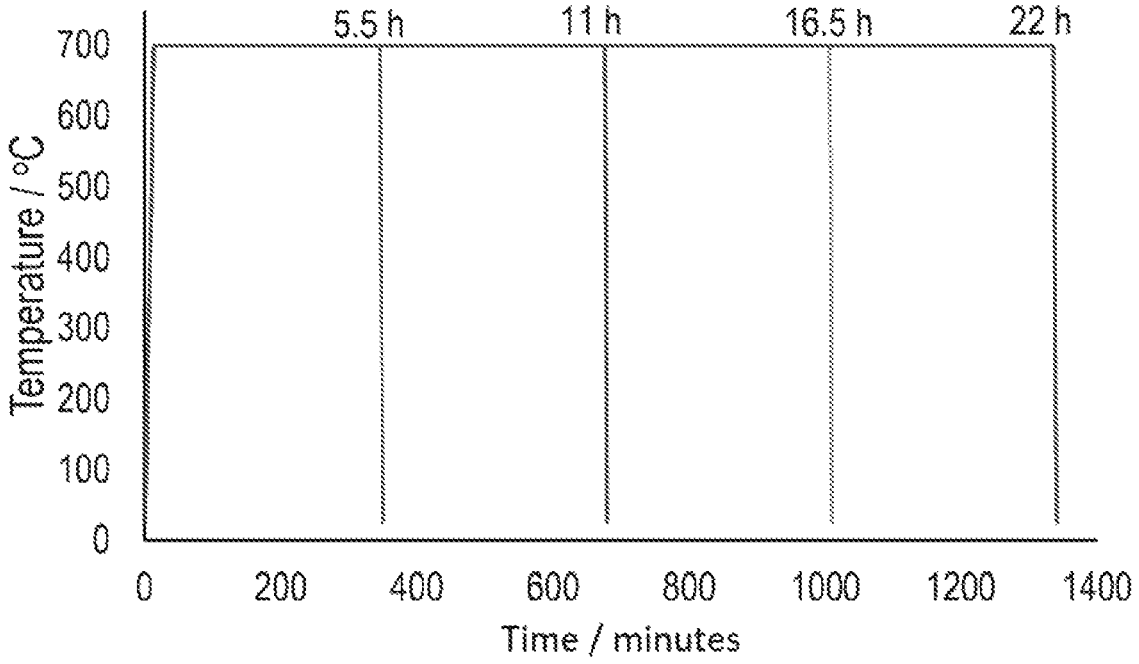

FIG. 7 indicates the temperature v/s time curve for four different specimens that are annealed for different time period, according to an exemplary embodiment of the present disclosure.

Figure 8A:
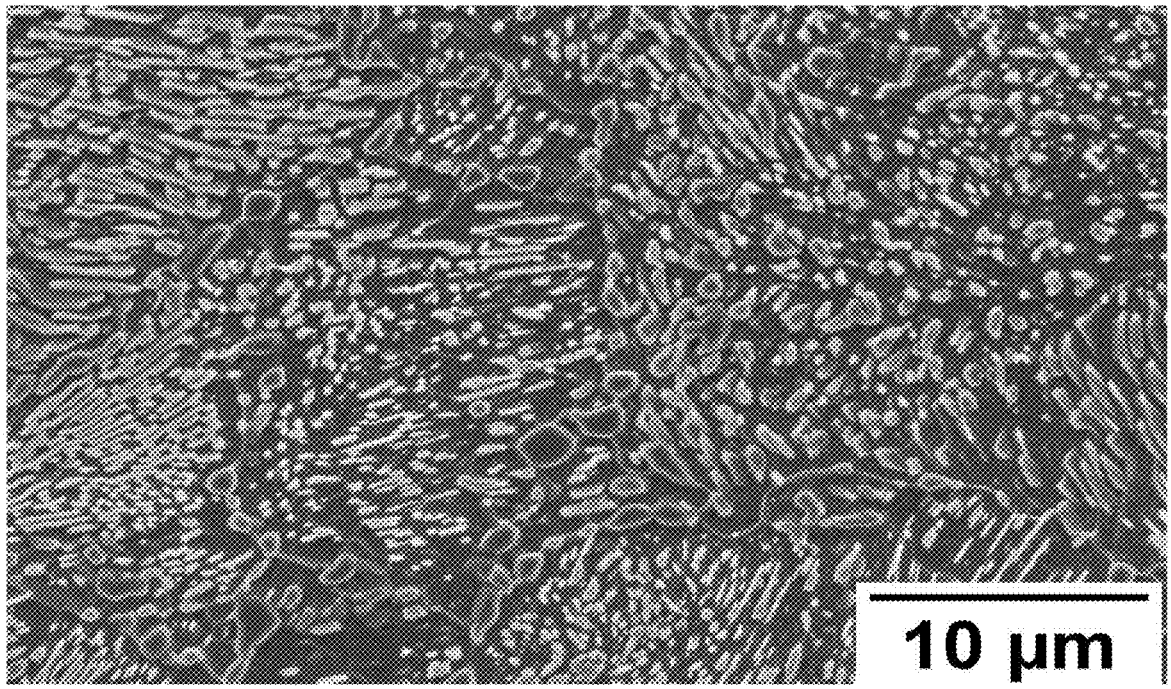
Figure 8B:
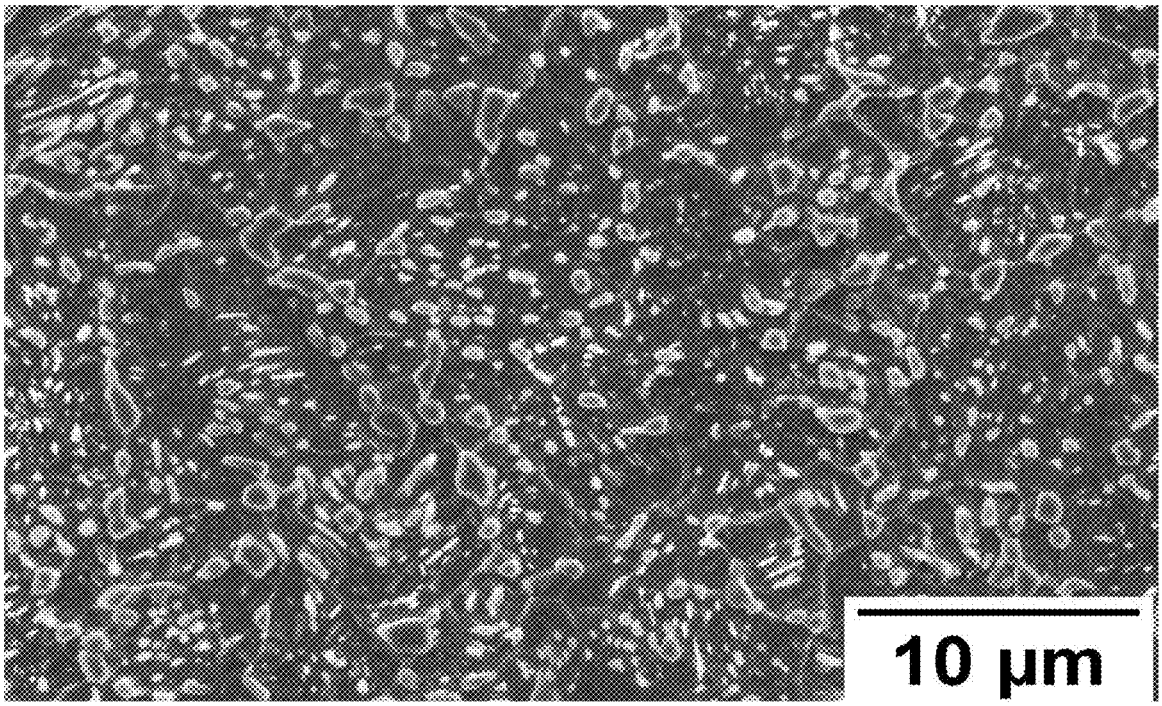

FIG. 8*a* and FIG. 8*b* illustrate the microstructure of steel strip subjected to 5.5 hours of annealing, produced by the rolling schedule in conventional methods and in the method of the present disclosure, respectively.

Figure 9A:
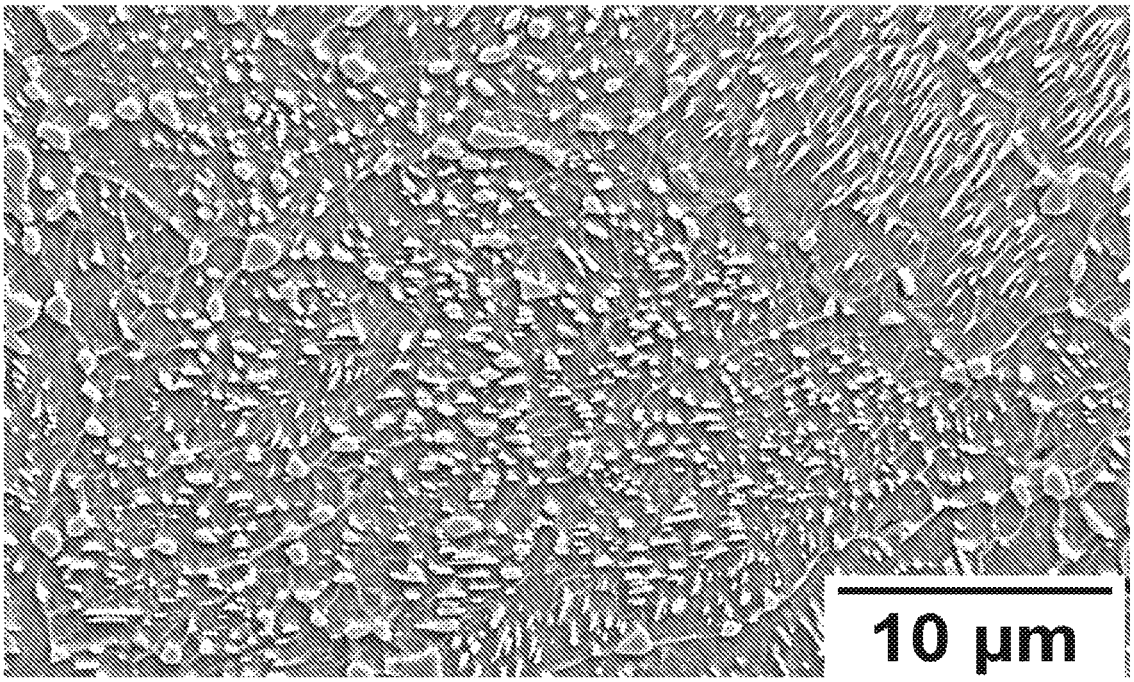
Figure 9B:
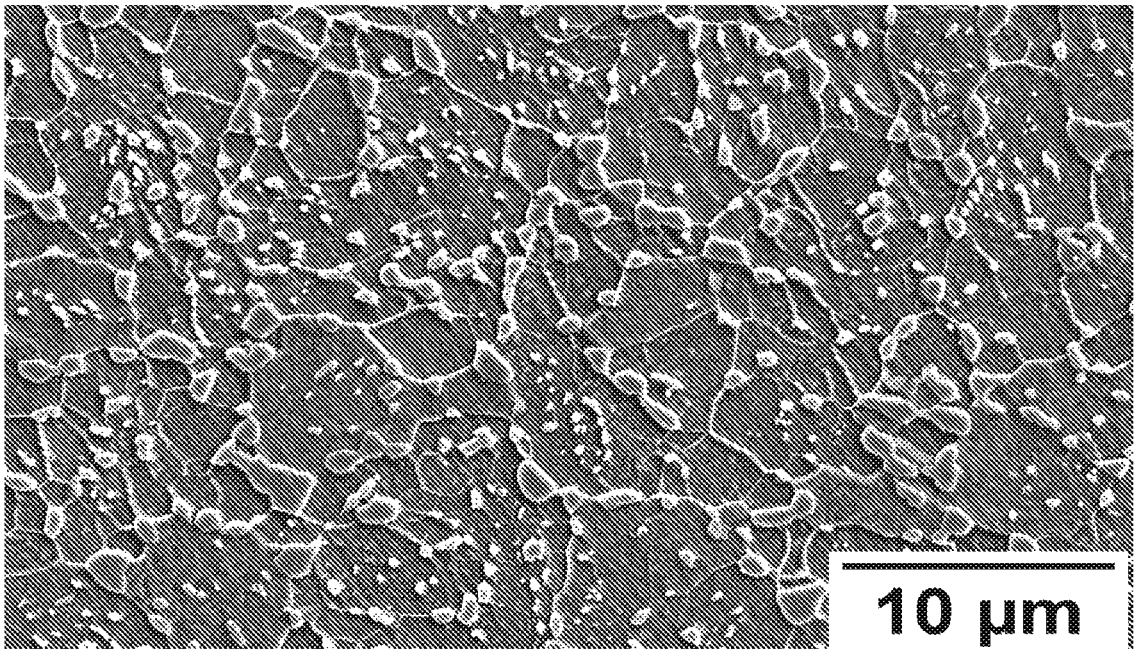

FIG. 9*a* and FIG. 9*b* illustrate the microstructure of steel strip subjected to 11 hours of annealing, produced by the rolling schedule in conventional methods and in the method of the present disclosure, respectively.

Figure 10A:
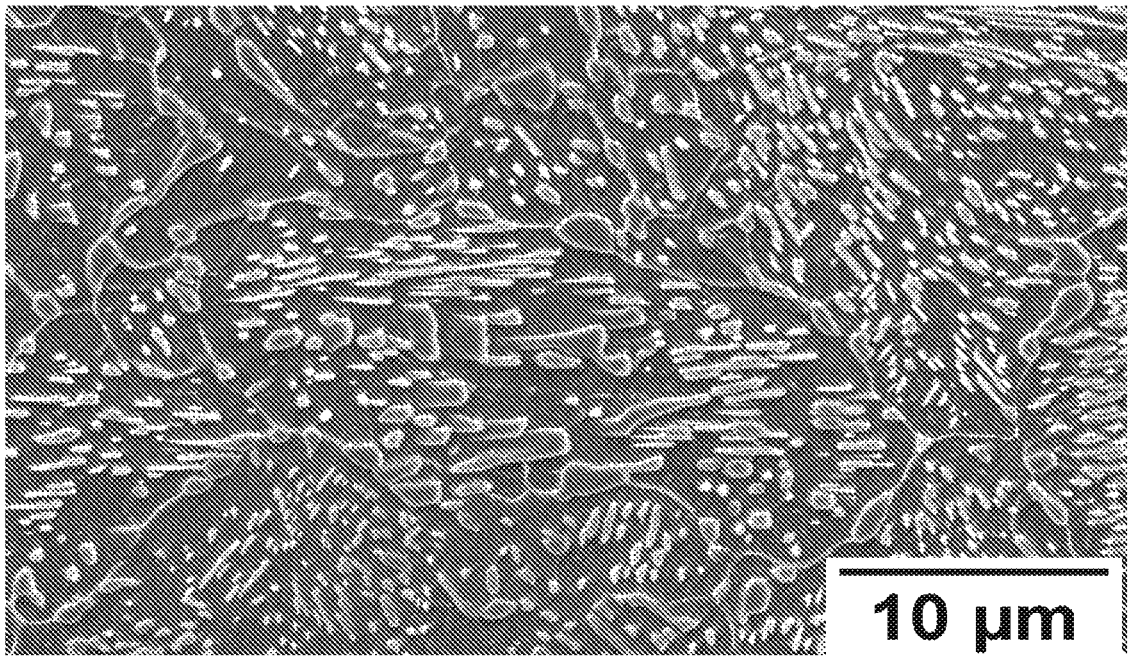
Figure 10B:
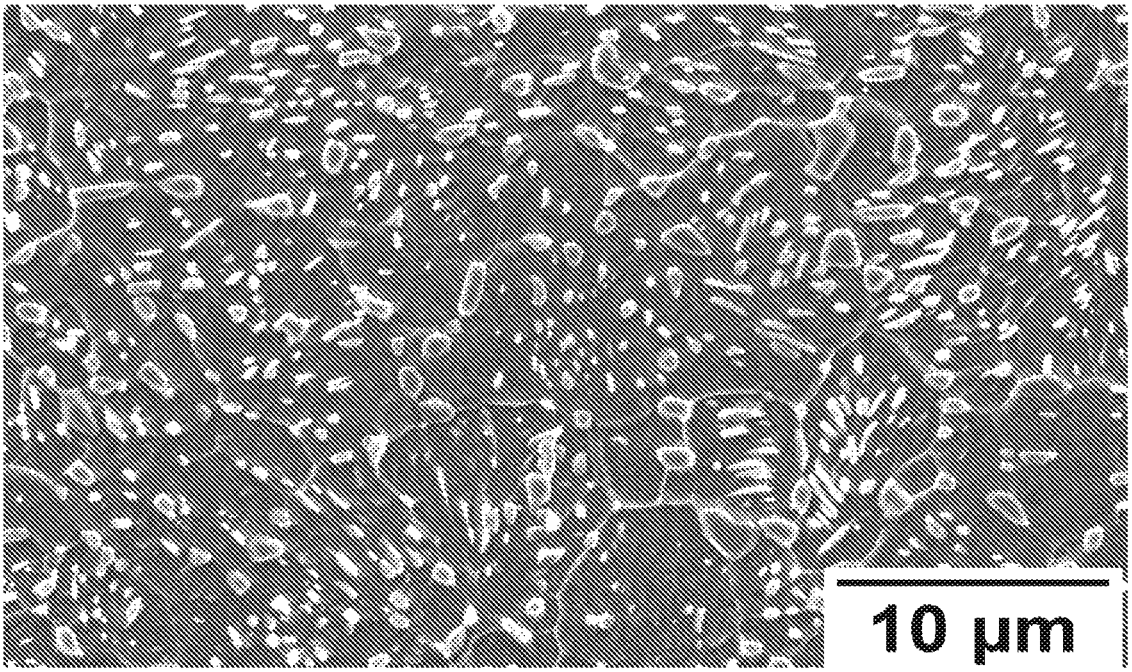

FIG. 10*a* and FIG. 10*b* illustrate the microstructure of steel strip subjected to 16.5 hours of annealing, produced by the rolling schedule in conventional methods and in the method of the present disclosure, respectively.

Figure 11A:
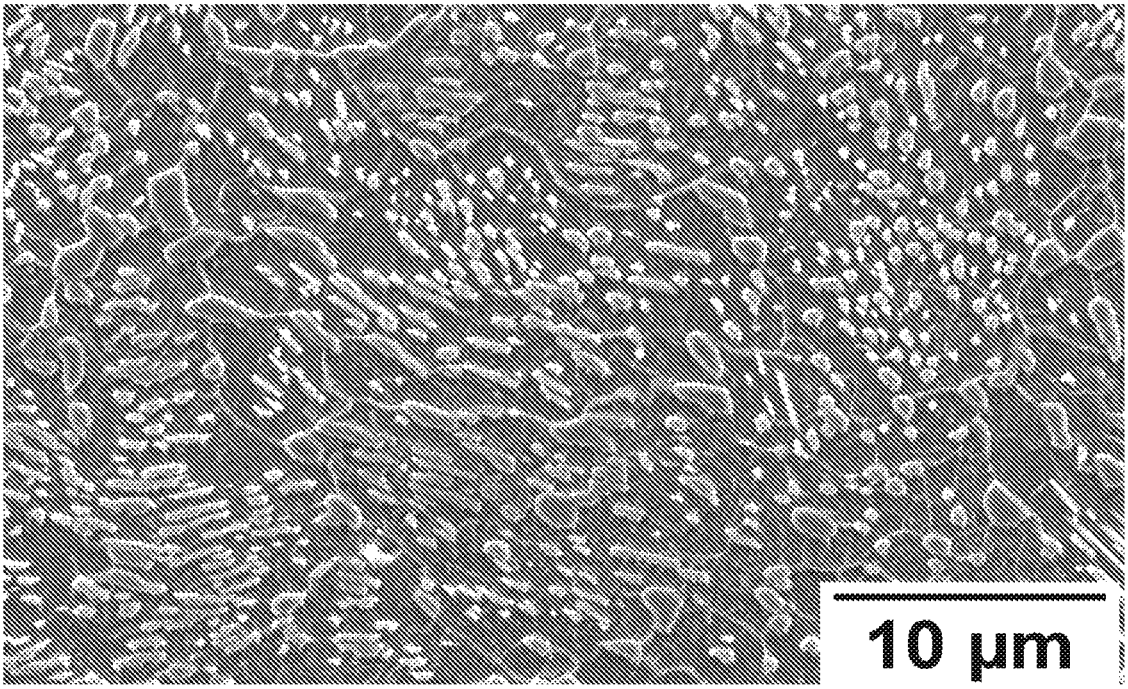
Figure 11B:
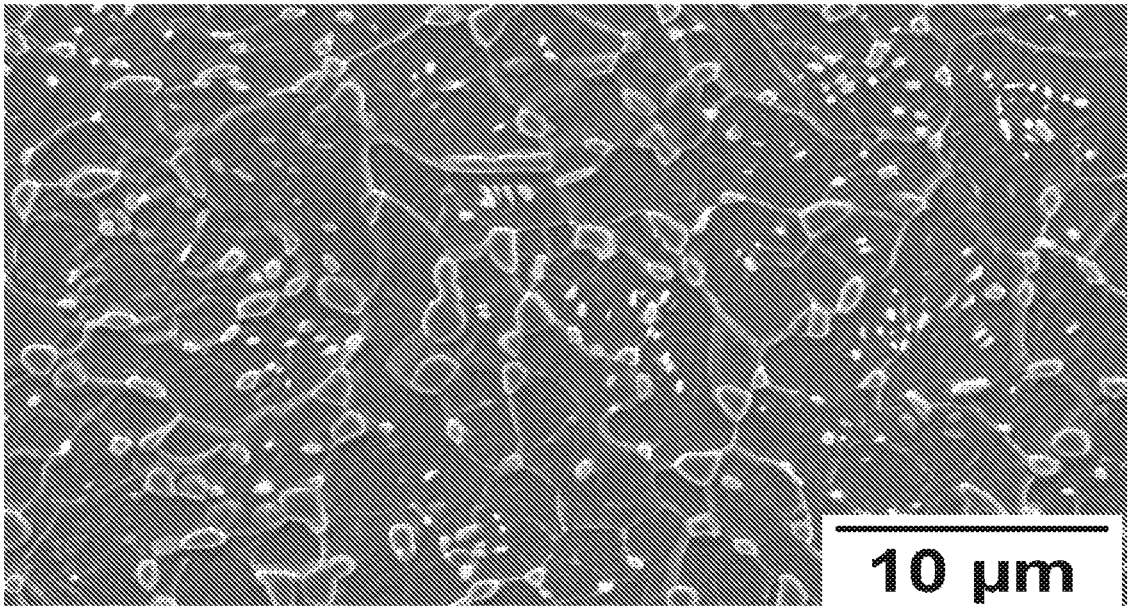

FIG. 11*a* and FIG. 11*b* illustrate the microstructure of steel strip subjected to 22 hours of annealing, produced by the rolling schedule in conventional methods and in the method of the present disclosure, respectively.

Figure 12:
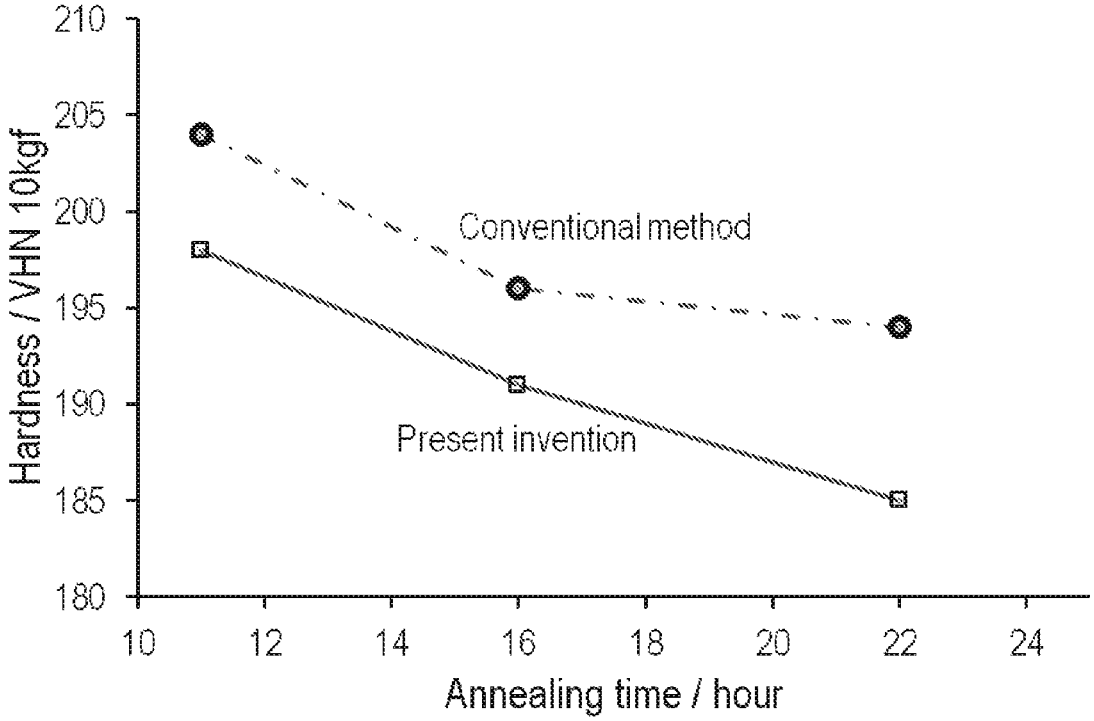

FIG. 12 illustrates hardness of steel strip subjected to annealing at 700° C., produced by the rolling schedule in conventional methods and in the method of the present disclosure.

The figures depict embodiments of the disclosure for purposes of illustration only. One skilled in the art will readily recognize from the following description that alternative embodiments of the methods illustrated herein may be employed without departing from the principles of the disclosure described herein.

DETAILED DESCRIPTION

The foregoing has broadly outlined the features and technical advantages of the present disclosure in order that the detailed description of the disclosure that follows may be better understood. Additional features and advantages of the disclosure will be described hereinafter which form the subject of the description of the disclosure. It should also be realized by those skilled in the art that such equivalent methods do not depart from the scope of the disclosure. The novel features which are believed to be characteristic of the disclosure, as to method of operation, together with further objects and advantages will be better understood from the following description when considered in connection with the accompanying figures. It is to be expressly understood, however, that each of the figures is provided for the purpose of illustration and description only and is not intended as a definition of the limits of the present disclosure.

In the present document, the word "exemplary" is used herein to mean "serving as an example, instance, or illustration." Any embodiment or implementation of the present subject matter described herein as "exemplary" is not necessarily to be construed as preferred or advantageous over other embodiments.

While the disclosure is susceptible to various modifications and alternative forms, specific embodiments thereof have been shown by way of example in the drawings and will be described in detail below. It should be understood, however that it is not intended to limit the disclosure to the particular form disclosed, but on the contrary, the disclosure is to cover all modifications, equivalents, and alternative falling within the spirit and the scope of the disclosure.

The terms "comprises", "comprising", or any other variations thereof, are intended to cover a non-exclusive inclusion, such that a method that comprises a list of acts does not include only those acts but may include other acts not expressly listed or inherent to such method. In other words, one or more acts in a method proceeded by "comprises . . . a" does not, without more constraints, preclude the existence of other acts or additional acts in the method.

Embodiments of the present disclosure disclose a high-strength hot-rolled steel sheet and a method for manufacturing a high-strength hot-rolled steel sheet. Strength, ductility, and formability are some of the important properties for the mass industrial application of high strength materials like steel.

According to various embodiment of the disclosure, a method for producing high strength hot rolled steel is disclosed. The method includes casting a steel slab of a composition, comprising in weight %: carbon (C) of about 0.45 wt. %-1.2 wt. %, manganese (Mn) of about 0.0-1.0 wt. %, silicon (Si) of about 0.0-0.5 wt. %, niobium (Nb) up-to 0.03 wt. %, sulphur (S) up-to 0.05 wt. % of S, phosphorous (P) up-to 0.05 wt. %, nitrogen (N) 0.002 wt. %-0.012 wt. % and balance being Iron (Fe) optionally along with incidental elements. The method also involves, hot rolling the steel slab at a temperature ranging from Ae3 to Ae3+100° C., where Ae3 is the temperature at which transformation of austenite to ferrite starts at equilibrium and strain accumulation takes place during at least two strands of hot rolling. The steel is further cooled to a coiling temperature at a cooling rate of 5° C./s-30° C./s. Further, the steel is coiled at the coiling temperature and is retained at an ambient temperature for 10-24 hr to obtain high strength hot rolled steel, where the high strength hot rolled steel is formed and comprises of 75-95% spheroid microstructure with 5-25% pearlite microstructure.

Henceforth, the present disclosure is explained with the help of figures for a method of manufacturing high-strength hot-rolled steel sheet. However, such exemplary embodiments should not be construed as limitations of the present disclosure since the method may be used on other types of steels where such need arises. A person skilled in the art may envisage various such embodiments without deviating from scope of the present disclosure.

Figure 1:
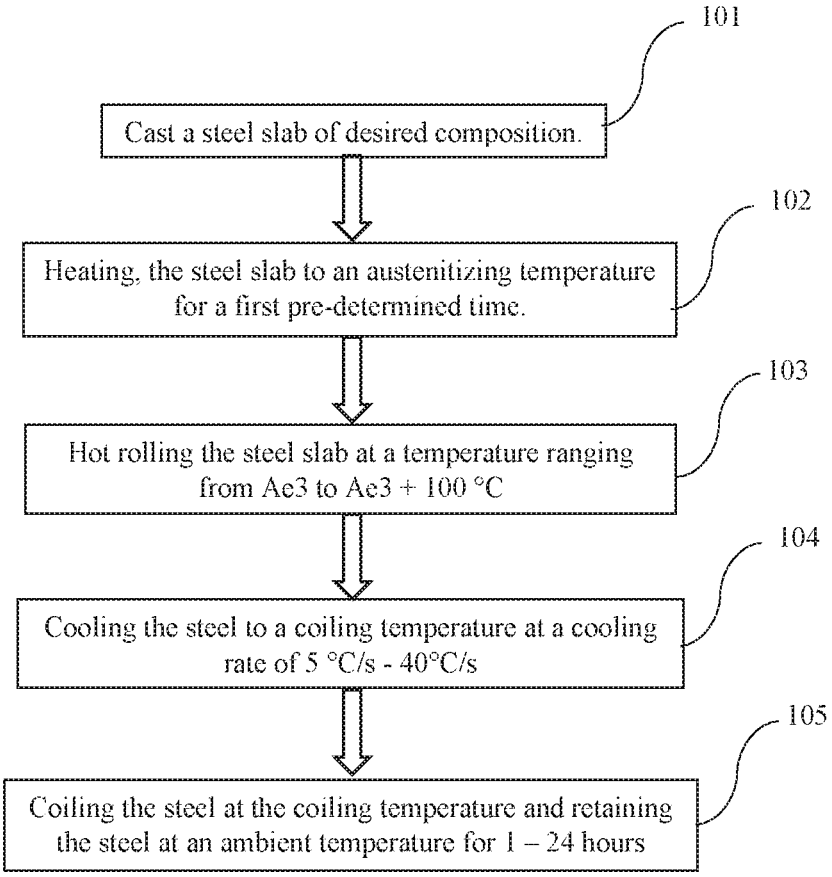

FIG. 1 is an exemplary embodiment of the present disclosure illustrating a flowchart of a method for producing high strength hot rolled steel. In the present disclosure, mechanical properties such machinability, toughness, ductility, tensile strength are improved. The steel produced by the method of the present disclosure, includes spheroids of cementite in hot rolled condition. The method is now described with reference to the flowchart blocks and is as below. The order in which the method is described is not intended to be construed as a limitation, and any number of the described method blocks can be combined in any order to implement the method. Additionally, individual blocks may be deleted from the methods without departing from the scope of the subject. The method is particularly applicable to high strength hot rolled steel, and it may also be extended to other type of steels as well.

The method of manufacturing the high strength low alloy steel sheet according to the present disclosure consists of a casting step followed by heating, hot rolling step, cooling and coiling. The various processing steps are described in their respective order below:

At block 101, a steel slab of desired alloy composition is formed by any of the manufacturing process such as casting including but not limited to continuous casting process. In an embodiment, the steel is made in the form of slabs, and the alloy may be prepared in at least one of air-melting furnace, and vacuum furnace. The steel slab may have composition of carbon (C) in a range of about 0.45 wt. %-1.2 wt. %, manganese (Mn) in the range of about 0.0-1.0 wt. %, silicon (Si) in a range of about 0.0-0.5 wt. %, niobium (Nb) up-to 0.03 wt. %, sulphur (S) up-to 0.05 wt. %, phosphorous (P) up-to 0.05 wt. %, nitrogen (N) 0.002 wt. %-0.012 wt. %, and iron (Fe) being remainder of the composition along with incidental elements may be casted in a continuous casting process.

The addition of each alloying element and the limitations imposed on each element are essential for achieving the required spheroid microstructure and the same is described below in detail.

Carbon (C) acts as a strengthening element and carbon in the range of about 0.45 wt. %-1.2 wt. % is generally used in medium and high carbon steels. The above-mentioned range of carbon is required to obtain the pearlitic microstructure of about 50% to 100% besides ferrite or cementite based on carbon content. Further, if the carbon content is less than 0.4 wt. % the overall desired strength of the steel may not be achieved. Excessive carbon more than 0.9 wt. % results in high amount of pro eutectoid cementite which is detrimental to ductility and toughness. Hence carbon is restricted in 0.4-0.9 wt. % range.

Manganese (Mn) in the range of about 0.0-1.0 wt. % not only imparts solid solution strengthening to the ferrite but it also lowers the austenite to ferrite transformation temperature thereby refining the ferrite grain size. The manganese level is restricted to 1% as higher levels of manganese enhances centre line segregation and banding during continuous casting. Silicon, like manganese, may be used as the solid solution strengthening element. However, Si leads surface scale problems in hot rolling and hence is restricted to less than 0.1% in order to prevent the formation of surface scales on the slab.

Niobium may be used for grain refinement. Niobium in solid solution, lowers the austenite to ferrite transformation temperature which refines the ferrite grain size. Further, in high carbon steels, mainly in eutectoid steels, addition of 0.025 wt. % Nb helps increase the drawability.

Excessive niobium promotes the formation of lower transformation products like bainite and hence is restricted to 0.035 wt. %.

Phosphorus content may be restricted to 0.025% as higher phosphorus levels may lead to reduction in toughness and weldability due to segregation of phosphorus into grain boundaries. The Sulphur content may also be limited to 0.05 wt. % since, excessive addition of sulphur results in a very high inclusion level that deteriorates formability.

Nitrogen (N) in the range of about 0.002 wt. %-0.012 wt. % is added as excessive nitrogen content raises the dissolution temperature of niobium and reduces the effectiveness of niobium. Reducing nitrogen levels also positively affects ageing stability and toughness in the heat-affected zone of the weld seam, as well as resistance to inter-crystalline stress-corrosion cracking. Consequently, nitrogen levels may be preferably kept below 0.007 wt. %.

Liquid steel with the above-mentioned composition and range of alloying elements is continuously casted into a slab. The liquid steel of the specified composition is first continuously casted either in a conventional continuous caster or a thin slab caster. When cast in a thin slab caster, the temperature of the cast slab may be restricted below 950° C. Further, if the slab temperature falls below 950° C., niobium precipitation and it becomes difficult to completely dissolve the precipitates in the subsequent reheating process rendering them ineffective for grain boundary pinning during reheating and finish rolling. Further, transverse cracks will develop in the slab if casted at low temperature below 950° C. Consequently, the temperature of the cast slab may be restricted below 950° C.

The method then includes the step of reheating the steel slab as shown in block 102. After casting the steel slab with the specified composition, the slabs may be heated in a furnace to an austenitizing temperature for a first predetermined time. In an embodiment, the steel slab may be hot charged into the furnace for heating, and the austenitizing temperature may be greater than 1100° C., preferably in the range of 1100° C. to 1250° C. Further, the first predetermined time ranges from about 20 minutes to 2 hours. The reheating temperature may be configured above 1100° C., to ensure complete dissolution of any precipitates of niobium (Nb) that may have formed in the preceding processing steps. Further, the reheating temperature greater than 1250° C. may not desirable since, higher reheating temperatures may lead to grain coarsening of austenite and excessive scale loss, therefore being limited to the range of 1100° C. to 1250° C.

The method further includes a step or a stage of hot working the steel slab by a hot working process [shown in block 103] immediately after heating. In an embodiment, the hot working process may be but not limited to hot rolling. Hot rolling is a metal forming process in which metal stock is passed through one or more pairs of rolls to reduce the thickness and to make the thickness uniform at high temperatures and hot rolling is carried out above the recrystallization temperature of the steel. After the grains deform during processing, they recrystallize, which maintains an equiaxed microstructure and prevents the metal from work hardening. In an embodiment, the hot charged steel slab may be hot rolled using hot mill strip. During hot rolling, hot charged steel slab may be subjected to roughing mill. The roughing mill usually consists of one or two roughing stands in which the steel slab may be hot rolled back and forth few times repeatedly to reach the thickness requirement. Roughing milled steel sheet may be further subjected to finish rolling. During finish rolling, the sheet surface may be subjected to further thickness reduction, surface finishing and dynamic recrystallization. The slab is hot rolled such that the strain accumulation takes place during the at least two stands of hot rolling. In an embodiment, the at least two strands are the last two stands of hot rolling. The strain accumulation is necessary for obtaining fine grain sizes of ferrite and to have fine pro-eutectoid cementite particles at grain boundary which help to produce 'non-lamellar' pearlite or spheroid microstructure upon transformation of austenite to ferrite. The strain accumulation during the last two strands and the desired austenite grain size is achieved by controlling parameters including finish rolling temperature ($T_{FRT}$) and strain rate.

The slab may be hot rolled into a hot rolled sheet at the finish rolling temperature ($T_{FRT}$). The rolling may be combination of rough rolling and finish rolling as in case of conventional hot strip mill or only through finish rolling as in case of continuous strip mill. The hot rolling may include the roughing step above the recrystallization temperature and a finishing step below the recrystallization temperature, when rolling is done in a conventional hot strip mill. The finish rolling temperature may range from Ae3 to Ae3+100° C., where Ae3 is the temperature at which transformation of austenite to ferrite starts at equilibrium and ranges from about 723° C. to about 940° C.

Further, the peak strain for hot rolling the steel is initially determined and the same may be applied to the rollers during the hot rolling process to achieve the desired austenite grain size in the steel. The following equations are used to set rolling parameters ($T_{FRT}$, d0, $\epsilon_{total}$, $\acute{\varepsilon}$) during hot rolling, to achieve the desired prior austenite grain size (d) in μm.

$$d = 1.53 \times 10^4 Z^{-0.25} \quad \text{(Eq. 1)}$$

$$Z = \acute{\varepsilon} \exp\left(\frac{266000}{RT}\right) \quad \text{(Eq. 2)}$$

Where $\acute{\varepsilon}$ is strain rate, T is $T_{FRT}$ in absolute temperature, R is gas constant.

$$\epsilon_p = A * Z^{-q} d_o^r \quad \text{(Eq. 3)}$$

The parameter determined from the above equation number 3, $\epsilon_p$ is the peak strain required to achieve desired prior austenite grain size "d". "A", "q" and "r" are constants with the following values of 2150, 0.12 and 0.3, respectively. Further, "$d_o$" in the equation number 3, is the initial grain size in the slab. The peak strain is determined by substituting the above-mentioned parameters in the equation number 3. Under given set of deformation conditions (T, d0, $\epsilon_{Total}$, $\dot{\varepsilon}$), the total applied strain must be sufficient to reach the peak strain required to obtain the refined microstructure. Further, from the above-mentioned equations, peak strain may be lowered by increasing strain rate and lowering the finishing temperature. Hot rolling the slab under the above-mentioned parameters ensures that fine grain size in the range of 2 μm to 5 μm obtained through strain accumulation during last two or three stand of finish rolling [seen from FIG. 2*b*].

Figure 2A:
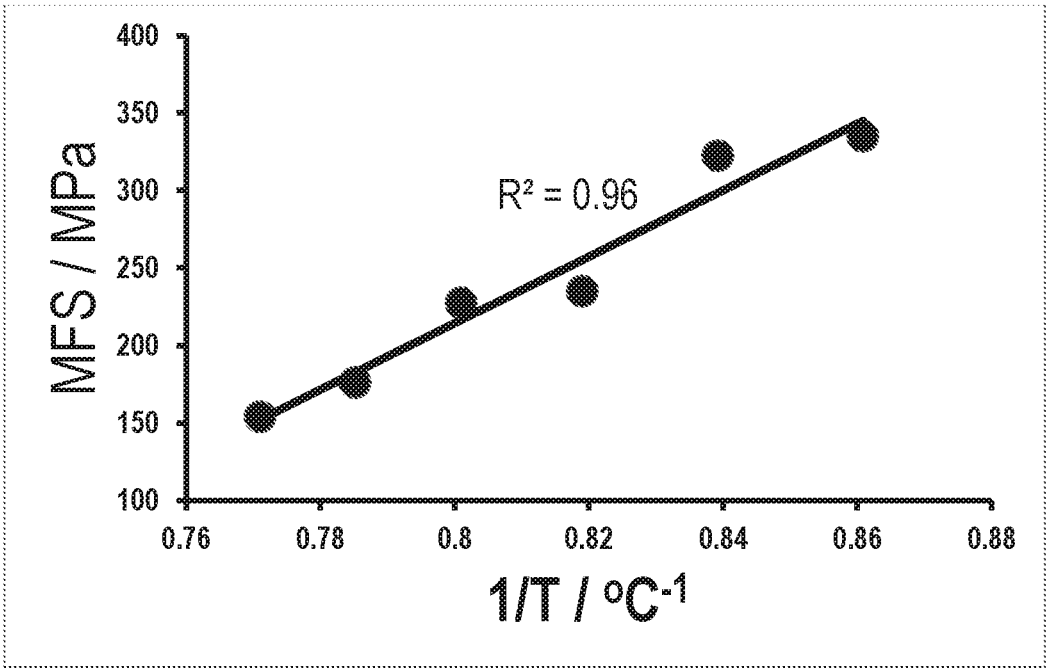
Figure 2B:
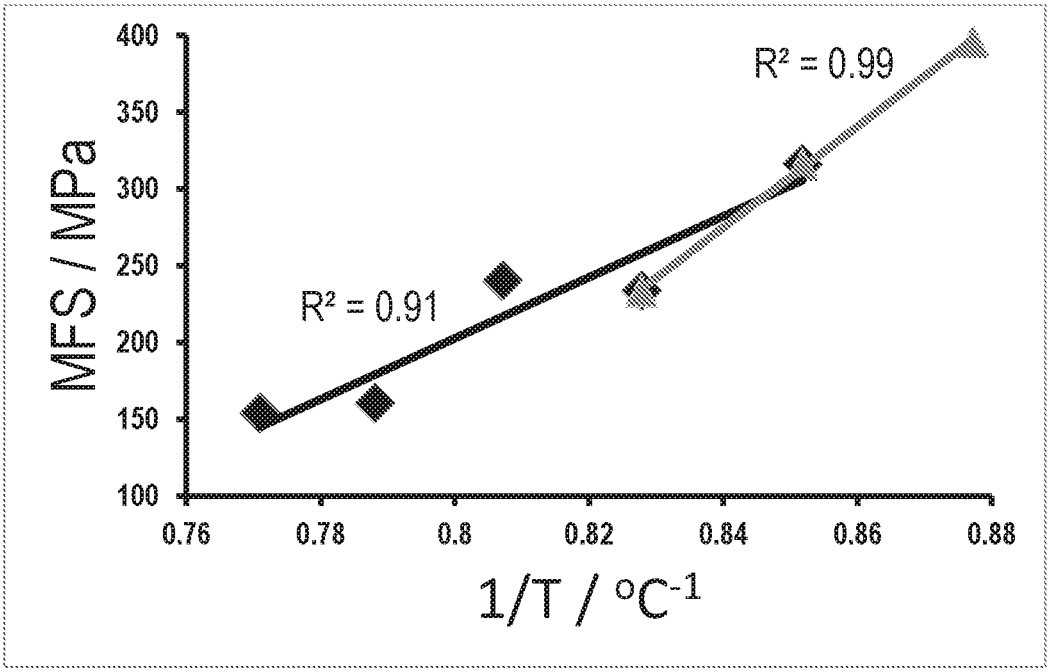

FIG. 2*a* is a graphical representation showing mean flow stress v/s temperature of the conventional rolling schedule which produce pearlite. FIG. 2*b* is a graphical representation showing mean flow stress v/s temperature of the rolling schedule of the present disclosure resulting in strain accumulation causing a refined grain size in the sheet. As seen from FIG. 2*b*, strain accumulation occurs during last three strands (triangle points and grey line) of hot rolling. Consequently, grain refinement and strain accumulation are obtained that are conducive for non-lamellar or spheroidized cementite. The rolling scheduled as mentioned above, ensures that strain accumulation occurs during last two or three stand of finish rolling. Consequently, as seen from FIG. 2*b*, the strip is subjected to higher mean flow stress of around 400 MPa. Higher mean flow stress and the rolling schedule where the strain accumulation occurs during the last two or three strands ensures that grain size in the range of 2 μm to 5 μm is obtained. Further, the above-mentioned rolling schedule also ensures that grain refinement and strain accumulation are obtained that are conducive for non-lamellar or spheroidized cementite. With further reference to FIG. 2*a*, there is no strain accumulation in the last two or three stands of hot rolling. Also, the maximum mean flow stress in conventional rolling schedule is only limited to around 350 MPa. Consequently, the grain structure is majorly of a pearlite microstructure and the conditions induced by the rolling schedule are also not accommodating for the conversion of the pearlitic microstructure to the non-lamellar or spheroidized cementite microstructure.

The next step [104] involves cooling the hot rolled steel. The hot rolled sheet is cooled on a run-out table. The run-out table usually includes a plurality of rollers for traversing the hot roller strip. The run-out table may be configured with a plurality of nozzles at a significant height from the rollers. The nozzles may generate or spray a thin curtain of water or any other coolant on the hot rolled strip traversing on the rollers. The coolant flow from the nozzles may be adjusted to control the cooling rate of the hot rolled steel sheet. The hot rolled steel sheet may be cooled by the run-out table and the cooling rate may range from 20° C./s-50° C./s. The cooling rate may be maintained to achieve a coiling temperature ($T_{CT}$). The coiling temperature is $Ae1-200<T_{CT}<Ae1-75$, where Ae1 is the temperature at which austenite to ferrite is completed. Further, the cooling rate may be between 5° C./s to 40° C./s. The cooling rate is determined based on multiple experiments such that the above-mentioned range of cooling rate assists in developing fine grain sized ferrite. Further, any pearlite formed during transformation will be spheroidized during coiling if the pearlite is very fine where cementite plates are very thin (~100 nm). Any coarse pearlite which is not spheroidized during later process, will lead to deterioration of machinability and ductility. The above-mentioned range of cooling rate minimizes the formation of the pearlite structure. The steel strip comprises of 75-95% spheroid microstructure and 5-25% pearlite microstructure. The above-mentioned cooling rate and the rolling schedule imparts the desired grain size of 2 μm-5 μm to the steel strip.

Referring to block 105, the method further includes the step of coiling the steel sheet after cooling the steel sheet to the coiling temperature. Coiling of the steel sheet is carried at temperature $Ae1-200<T_{CT}<Ae1-75$. Multiple experiments are conducted, and it was determined that high coiling temperature leads to coarse cementite while low coiling temperature may produce undesired microstructures. After coiling, the coil is allowed to cool at ambient temperature without uncoiling for 1 hours-24 hours to spheroidize cementite in pearlite. The microstructure obtained comprises nanometre sized cementite particles in the ferrite matrix. The microstructure is uniform or in other words cementite phase is distributed uniformly throughout the ferrite matrix. Furthermore, bainite, martensite or degenerate pearlite is avoided and high strength steel with nano-sized cementite in ferrite matrix in sheet achieved. Consequently, the machinability, ductility, toughness, and strength are drastically improved.

Example

Further embodiments of the present disclosure will now be described with examples of composition of the steel. Experiments have been carried out on the steel by using method of the present disclosure.

For the purpose of experiment, a slab of the composition mentioned in the below table 1 is casted.

TABLE 1

| C | Mn | S | F | Si | Al | N/ppm | Cr |
|---|---|---|---|---|---|---|---|
| 0.8019 | 0.639 | 0.007 | 0.027 | 0.237 | 0.03 | 45 | 0.129 |

For comparison, the conventionally produced pearlite steel is compared with the present disclosure. The slab is reheated and then hot rolled through roughing mill and finishing mill. The rolling schedule, and critical temperatures for conventional steel and steel of the present disclosure are given in below Table 2 and 3.

TABLE 2

| | Conventional method | | | | | Method of present disclosure | | | | |
|---|---|---|---|---|---|---|---|---|---|---|
| Stand no. | Thickness/ mm | Reduction/ % | Force/ MN | Speed/ $ms^{-1}$ | MFS/ MPa | Thickness/ mm | Reduction/ % | Force/ MN | Speed/ $ms^{-1}$ | MFS/ MPa |
| 1 | 17.26 | 40.48 | 17.23 | 0.99 | 154 | 17.16 | 40.83 | 17.11 | 1.04 | 154 |
| 2 | 11.61 | 32.73 | 14.63 | 1.48 | 176 | 11.47 | 33.16 | 13.52 | 1.514 | 160 |
| 3 | 8.46 | 27.13 | 14.24 | 2.04 | 227 | 8.29 | 27.72 | 15.45 | 2.132 | 240 |

TABLE 2-continued

| | Conventional method | | | | | Method of present disclosure | | | | |
|---|---|---|---|---|---|---|---|---|---|---|
| Stand no. | Thickness/ mm | Reduction/ % | Force/ MN | Speed/ $ms^{-1}$ | MFS/ MPa | Thickness/ mm | Reduction/ % | Force/ MN | Speed/ $ms^{-1}$ | MFS/ MPa |
| 4 | 6.55 | 22.58 | 12.06 | 2.63 | 235 | 6.36 | 23.28 | 12.51 | 2.762 | 234 |
| 5 | 5.3 | 19.08 | 13.16 | 3.28 | 322 | 5.11 | 19.65 | 13.22 | 3.448 | 316 |
| 6 | 4.55 | 14.15 | 10.33 | 3.84 | 335 | 4.55 | 10.96 | 10 | 4.02 | 396 |

The above table 2 indicates the rolling parameters of the conventional method where pearlite microstructure is obtained and method of the present disclosure where spheroidized cementite structure is obtained.

TABLE 3

| | Finish mill entry temperature/ ° C. | Finish rolling temperature/ ° C. | Coiling temperature/ ° C. | Coil holding time/hr |
|---|---|---|---|---|
| Conventional method | 1050 | 851 | 610 | — |
| New method | 1050 | 829 | 610 | 10-24 |

The above table 3 indicates the critical operational temperature of the conventional rolling schedule and the rolling schedule of the present disclosure. The rolling schedule of the present disclosure imparts a prior austenite grain size (PAG) of about 5 μm. parameters such as temperature, strain rate and strain play a critical role in imparting the desired microstructure. The peak strain $\epsilon_p$ as determined from the above rolling schedule is required to obtain the desired grain size ranging from 2 μm to 5 μm. The various operational parameters determined from the above rolling schedule is illustrated in the below table 4.

TABLE 4

| | FRT/° C. | $\dot{\varepsilon}$/s−1 | $\epsilon_p$ | $\epsilon_{Total}$ | PAG/μm |
|---|---|---|---|---|---|
| Conventional | 850 | 75 | 2.27 | 2.23 | n/a |
| New | 829 | 85 | 2.03 | 2.24 | 3.5 |

It is evident from the above table that peak strain in the rolling schedule of the present disclosure may be achieved as it is less than the total applied strain to achieve desired prior austenite grain size. The PAG cannot be calculated in the conventional case as the peak strain required is more than the total applied strain. FIGS. 2*a* and 2*b* show the resultant mean flow stress plots. It is evident that mean flow stress is higher in the new method compared to the conventional method that results in finer prior austenite gain size.

TABLE 5

| Specimen label | YS/MPa Yield stress | UTS/MPa Ultimate tensile stress | TEL/% Total elongation | UEL/% Uniform elongation |
|---|---|---|---|---|
| R_1 | 652 | 952 | 16.3 | 9.4 |
| R-2 | 653 | 955 | 15.4 | 9.2 |
| R-3 | 643 | 964 | 18.7 | 10.1 |
| Rolled direction | 649 | 957 | 16.8 | 9.6 |
| T_1 | 657 | 952 | 15.8 | 9.3 |
| T-2 | 669 | 958 | 14.7 | 8.8 |
| T-3 | 661 | 951 | 14.8 | 8.6 |

TABLE 5-continued

| Specimen label | YS/MPa Yield stress | UTS/MPa Ultimate tensile stress | TEL/% Total elongation | UEL/% Uniform elongation |
|---|---|---|---|---|
| Transverse direction | 663 | 954 | 15.1 | 8.9 |
| Average | 656 | 955 | 16 | 9 |
| Standard deviation | 9 | 5 | 1 | 1 |

The above Table 5 describes mechanical properties of steel produced with the method as disclosed in the present disclosure with cementite in spheroidized or 'non-lamella' form.

TABLE 6

| Ref. no | YS/MPa Yield stress | UTS/MPa Ultimate tensile stress | TEL/% Total elongation |
|---|---|---|---|
| 1 | 663 | 1046 | 8.0 |
| 2 | 944 | 1048 | 11.0 |
| 3 | 902 | 1077 | 9.0 |
| 4 | 902 | 1077 | 9.0 |
| Average | 853 | 1062 | 9.3 |
| Standard deviation | 128 | 17 | 1 |

The above Table 6 describes mechanical properties of conventionally produced steel with cementite in lamellar form of the present disclosure. It can be noticed that the steel produced in the present invention has improved properties.

Figure 3:
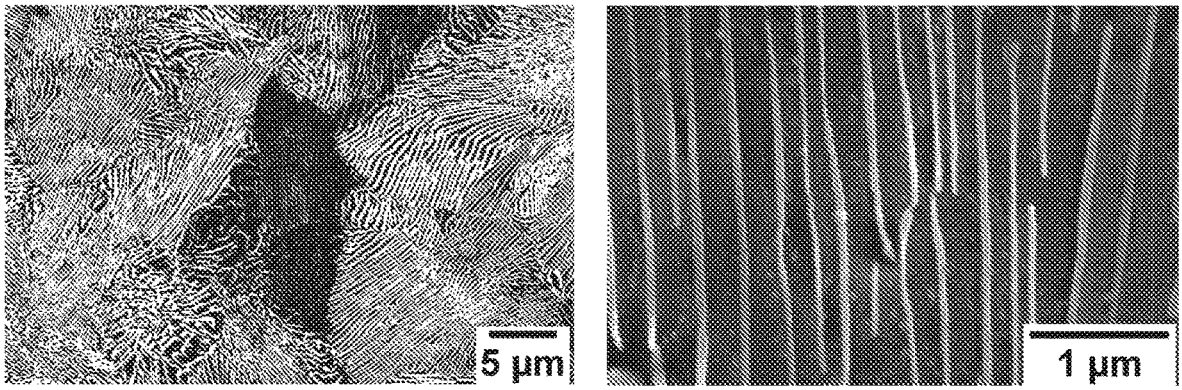
FIG. 3 shows micrographic view of steel having pearlite microstructure obtained from the conventional rolling schedule with alternative layers of cementite and ferrite.
Figure 4:
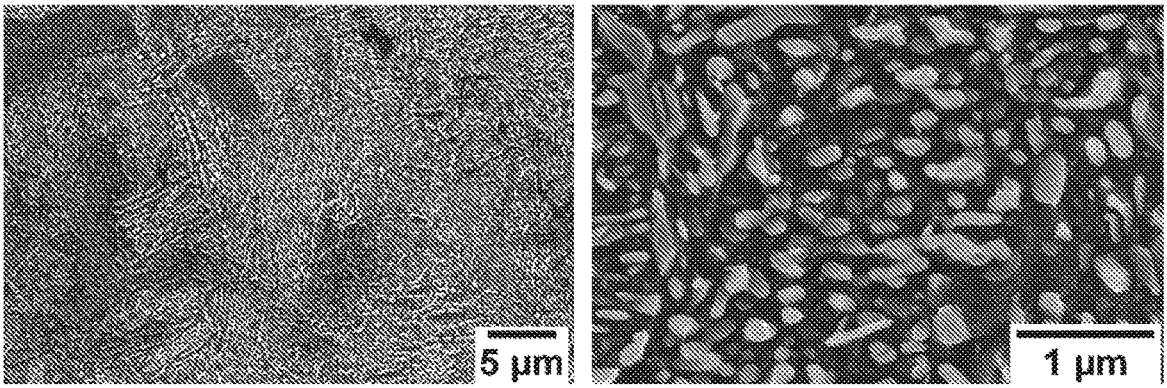
FIG. 4 shows micrographic view of steel having spheroid cementite microstructure in ferrite matrix produced with the rolling schedule of the present disclosure, according to an exemplary embodiment of the present disclosure.
Figure 5:
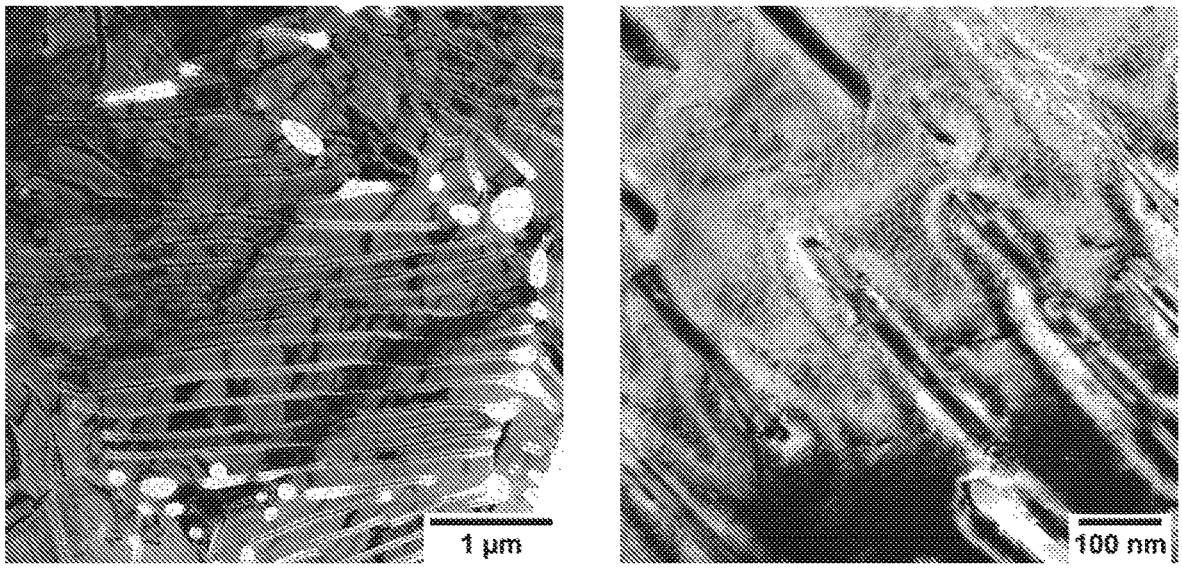
FIG. 5 shows bright field (BF) images of steel containing pearlite, which was produced with the conventional rolling schedule.
Figure 6:
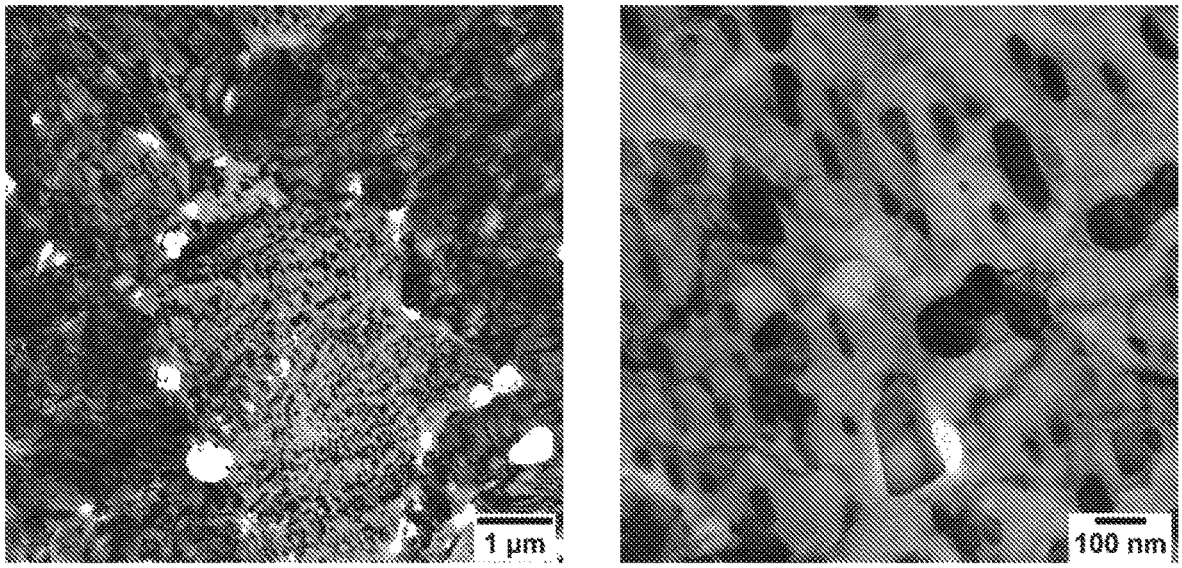
FIG. 6 shows bright field (BF) images of steel containing cementite in the form of spheroids which is produced with the rolling schedule of the present disclosure, according to an exemplary embodiment of the present disclosure.

The microstructures of the steels are shown in FIGS. 3, 4, 5 and 6. FIG. 3 shows pearlite microstructure obtained from the conventional rolling method with alternative layers of cementite and ferrite. FIG. 4 shows spheroid cementite microstructure in ferrite matrix produced with the rolling schedule of the present disclosure. Further, FIG. 5 shows bright field (BF) images of steel containing pearlite which was produced with the conventional rolling schedule and FIG. 6 shows bright field (BF) images of steel containing cementite in the form of spheroids which were produced with the rolling schedule of the present disclosure. It is clear from the microstructure that the present disclosure has resulted in nanometre sized cementite. It is evident from the figure and table that steel developed by the method of present disclosure has minimum 950 MPa of tensile strength, 10% uniform elongation and minimum 15% total elongation. The strip has high strain hardening co-efficient of 0.2 and yield ratio (Yield strength to Tensile strength) between 0.6 & 0.7. The steel also has nanoscale cementite in non-lamellar or spheroidized form and ferrite with grain size less than 5 μm. Further, hardness of steel strip rolled with present invention ranges from 288 to 296 compared to hardness ranging from 309 to 319 with conventional rolling methods. Therefore, steel strip produced through the present invention is more ductile due to its spheroidized form of cementite or non-lamellar microstructure.

In another exemplary embodiment of the present disclosure, experiments were carried out for annealing the steel produced using method of the present disclosure and conventional methods at different time intervals. The FIG. 7 indicates the temperature v/s time curve for four different specimens that were annealed for 5.5 hours, 11 hours, 16.5 hours, and 22 hours at 700° C. FIG. 8*a* and FIG. 8*b* illustrate the microstructure of steel strip subjected to 5.5 hours of annealing, produced by the rolling schedule in conventional methods and in the method of the present disclosure, respectively. FIG. 9*a* and FIG. 9*b* illustrate the microstructure of steel strip subjected to 11 hours of annealing, produced by the rolling schedule in conventional methods and in the method of the present disclosure, respectively. FIG. 10*a* and FIG. 10*b* illustrate the microstructure of steel strip subjected to 16.5 hours of annealing, produced by the rolling schedule in conventional methods and in the method of the present disclosure, respectively. FIG. 11*a* and FIG. 11*b* illustrate the microstructure of steel strip subjected to 22 hours of annealing, produced by the rolling schedule in conventional methods and in the method of the present disclosure, respectively. It is clear from the FIGS. 8*b*, 9*b*, 10*b* and 11*b* that the microstructure in the steel strip of present invention resulted in development of non-lamellar or spheroidized structure with grain size less than 5 μm. Whereas the steel strip produced by conventional methods majorly comprise of unrefined pearlitic microstructure with grain size greater than 5 μm. Further, FIG. 12 illustrates the hardness of steel strip subjected to annealing at 700° C. From the figure it is evident that steel strip produced with the present invention compared to the conventional method rapidly softens which is one of the main reason for annealing. As seen from FIG. 12, hardness of hot rolled steel rages from 188 to 192 after annealing for 11 hours at 700° C. Further, the hardness after annealing for 22 hours at 700° C. and after annealing for 1-week at 700° C. ranges from 178 to 182 and 158 to 162, respectively.

In an embodiment, machinability, ductility, and toughness of the steel is improved due to the spheroidized or non-lamellar structure of steel in hot-rolled condition. The steel also possesses a minimum tensile strength of 950 MPa with good formability and good surface quality.

In an embodiment, the method of the present disclosure enables the mass produced of steel with structure mainly consisting of spheroids of cementite or non-lamellar pearlite in hot rolled condition to achieve excellent uniform elongation without need of prolonged isothermal treatment or complex heat-treatment steps at high temperatures which incur huge cost.

EQUIVALENTS

With respect to the use of substantially any plural and/or singular terms herein, those having skill in the art can translate from the plural to the singular and/or from the singular to the plural as is appropriate to the context and/or application. The various singular/plural permutations may be expressly set forth herein for sake of clarity.

It will be understood by those within the art that, in general, terms used herein, and especially in the appended claims (e.g., bodies of the appended claims) are generally intended as "open" terms (e.g., the term "including" should be interpreted as "including but not limited to," the term "having" should be interpreted as "having at least," the term "includes" should be interpreted as "includes but is not limited to," etc.). It will be further understood by those within the art that if a specific number of an introduced claim recitation is intended, such an intent will be explicitly recited in the claim, and in the absence of such recitation no such intent is present. For example, as an aid to understanding, the following appended claims may contain usage of the introductory phrases "at least one" and "one or more" to introduce claim recitations. However, the use of such phrases should not be construed to imply that the introduction of a claim recitation by the indefinite articles "a" or "an" limits any particular claim containing such introduced claim recitation to inventions containing only one such recitation, even when the same claim includes the introductory phrases "one or more" or "at least one" and indefinite articles such as "a" or "an" (e.g., "a" and/or "an" should typically be interpreted to mean "at least one" or "one or more"); the same holds true for the use of definite articles used to introduce claim recitations. In addition, even if a specific number of an introduced claim recitation is explicitly recited, those skilled in the art will recognize that such recitation should typically be interpreted to mean at least the recited number (e.g., the bare recitation of "two recitations," without other modifiers, typically means at least two recitations, or two or more recitations). Furthermore, in those instances where a convention analogous to "at least one of A, B, and C, etc." is used, in general such a construction is intended in the sense one having skill in the art would understand the convention (e.g., "a system having at least one of A, B, and C" would include but not be limited to systems that have A alone, B alone, C alone, A and B together, A and C together, B and C together, and/or A, B, and C together, etc.). In those instances where a convention analogous to "at least one of A, B, or C, etc." is used, in general such a construction is intended in the sense one having skill in the art would understand the convention (e.g., "a system having at least one of A, B, or C" would include but not be limited to systems that have A alone, B alone, C alone, A and B together, A and C together, B and C together, and/or A, B, and C together, etc.). It will be further understood by those within the art that virtually any disjunctive word and/or phrase presenting two or more alternative terms, whether in the description, claims, or drawings, should be understood to contemplate the possibilities of including one of the terms, either of the terms, or both terms. For example, the phrase "A or B" will be understood to include the possibilities of "A" or "B" or "A and B."

While various aspects and embodiments have been disclosed herein, other aspects and embodiments will be apparent to those skilled in the art. The various aspects and embodiments disclosed herein are for purposes of illustration and are not intended to be limiting, with the true scope and spirit being indicated by the following claims.

Referral Numerals

| Referral Numerals | Description |
|---|---|
| 101 | Casting stage |
| 102 | Re-heating stage |
| 103 | Hot rolling stage |
| 104 | Cooling stage |
| 105 | Coiling stage |

We claim:

1. A method for producing high strength hot rolled steel, the method comprising:

casting, a steel slab of a composition, comprising in weight %:

carbon (C) of 0.45%-1.2%, manganese (Mn) of 0.0-1.0%, silicon (Si) of 0.0-0.5%, niobium (Nb) up to 0.03%, sulphur(S) up to 0.05%, phosphorous (P) up to 0.05%, nitrogen (N) 0.002%-0.012%, balance being Iron (Fe) optionally along with incidental elements;

heating, the steel slab to an austenitizing temperature for a first pre-determined time;

hot rolling the steel slab at a temperature ranging from Ae3 to Ae3+100° C., wherein Ae3 is the temperature at which transformation of austenite to ferrite starts at equilibrium and strain accumulation takes place during at least two strands of hot rolling;

cooling the steel to a coiling temperature at a cooling rate of 5° C./s-40° C./s; and coiling the steel at the coiling temperature, wherein the coiling temperature is $Ae1-175<T_{CT}<Ae1-75$, wherein Ae1 is the temperature at which austenite to ferrite is completed, and retaining the steel at an ambient temperature for 1-24 hours to obtain high strength hot rolled steel, wherein, the high strength hot rolled steel comprises 75-95% (by volume %) of spheroid microstructure and 5-25% (by volume %) of pearlite microstructure, and wherein the spheroid microstructure is obtained without need of prolonged isothermal treatment or complex heat-treatment steps at high temperatures.

2. The method as claimed in claim 1, wherein the high strength hot rolled steel exhibits ultimate tensile strength greater than 950 MPa.

3. The method as claimed in claim 1, wherein the austenitizing temperature ranges from 1100° C. to 1250° C. and the first pre-determined time ranges from 20 minutes to 2 hours.

4. The method as claimed in claim 1, wherein the Ae3 temperature ranges from of 850° C. to 940° C.

5. The method as claimed in claim 1, wherein strain accumulation during the at least two strands of hot rolling is achieved by controlling parameters including strain rate, finish rolling temperature and a desired austenite grain size during the hot rolling.

6. The method as claimed in claim 5, wherein the at least two strands are the last two stands of hot rolling.

7. The method as claimed in claim 5, wherein the parameters are determined by calculating a peak strain for hot rolling the steel to achieve a desired austenite grain size in the steel.

8. The method as claimed in claim 1, wherein the steel is retained at an ambient temperature for time-period ranging from 1 hour to 11 hours to obtain high strength hot rolled steel.

9. The method as claimed in claim 1, wherein the high strength hot rolled steel exhibits total elongation greater than 15%, the grain size of high strength hot rolled steel ranges from 2 μm to 5 μm, the size of the spheroid microstructure in steel is below 200 nm and average size of the spheroids is 100 nm, the yield to tensile strength ratio of the high strength hot rolled steel is between 0.65-0.75, and the strain hardening exponent of the high strength hot rolled steel is between 0.18-0.2.

* * * * *